US009010571B2

(12) United States Patent
Bailey

(10) Patent No.: US 9,010,571 B2
(45) Date of Patent: Apr. 21, 2015

(54) LOOSE FILL TRAY PACKAGING SYSTEM

(75) Inventor: Ryan A. Bailey, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 173 days.

(21) Appl. No.: 13/513,467

(22) PCT Filed: Dec. 16, 2010

(86) PCT No.: PCT/US2010/060627

§ 371 (c)(1),
(2), (4) Date: Jun. 1, 2012

(87) PCT Pub. No.: WO2011/075546

PCT Pub. Date: Jun. 23, 2011

(65) Prior Publication Data

US 2012/0234854 A1 Sep. 20, 2012

Related U.S. Application Data

(60) Provisional application No. 61/287,968, filed on Dec. 18, 2009.

(51) Int. Cl.
*B65D 83/04* (2006.01)
*B65D 25/00* (2006.01)

(52) U.S. Cl.
CPC ..... *B65D 83/0409* (2013.01)

(58) Field of Classification Search
USPC ..... 221/67, 191, 193, 194, 195, 288, 289
See application file for complete search history.

(56) References Cited

U.S. PATENT DOCUMENTS

| | | | | | |
|---|---|---|---|---|---|
| 1,988,134 | A * | 1/1935 | Nitardy | 206/534.1 |
| 2,086,296 | A * | 7/1937 | Gilbert | 221/202 |
| 2,605,892 | A * | 8/1952 | Waber et al. | 221/246 |
| 3,053,383 | A * | 9/1962 | Kahn | 206/540 |
| 3,301,437 | A | 1/1967 | Faber | |
| 4,120,400 | A * | 10/1978 | Kotyuk | 206/528 |
| 4,502,612 | A * | 3/1985 | Morrison | 221/185 |
| 4,557,690 | A * | 12/1985 | Randin | 433/49 |
| 6,068,126 | A * | 5/2000 | DeJonge | 206/538 |
| 7,216,776 | B2 * | 5/2007 | Gelardi | 221/256 |
| 7,360,669 | B2 * | 4/2008 | Drajan | 221/260 |
| 7,591,372 | B2 | 9/2009 | Gelardi et al. | |
| D638,297 | S * | 5/2011 | Gelardi et al. | D9/456 |
| 8,397,945 | B2 * | 3/2013 | Gelardi et al. | 221/45 |
| 2004/0094567 | A1 * | 5/2004 | Pollock et al. | 221/289 |

(Continued)

FOREIGN PATENT DOCUMENTS

EP 2107011 10/2009

*Primary Examiner* — Gene Crawford
*Assistant Examiner* — Kelvin L Randall, Jr.
(74) *Attorney, Agent, or Firm* — MeadWestvaco Intellectual Property Group

(57) ABSTRACT

Disclosed is a packaging system (10) for containing and dispensing loose filled product units. An inverted tray (20) is sealed to a backer board (40) with a guide insert disposed there between defining an interior chamber that is also filled with product units. The guide insert may include a base flange (38), a pair of side flanges for funneling product units into the truncated area that defines a next dispensing position. A flexible bridge (34) includes at least one high point and a fence portion that can descend into the base flange upon application of sufficient pressure to the at least one high point. This allows a product unit to advance to a dispensing position such that product units can be dispensed one at a time through user manipulation of the flexible bridge.

11 Claims, 6 Drawing Sheets

(56) References Cited

U.S. PATENT DOCUMENTS

2004/0164085 A1* 8/2004 Kitching et al. ..... 221/45
2005/0263539 A1* 12/2005 Haggerty et al. ..... 221/263
2008/0035643 A1* 2/2008 Hoffman et al. ..... 220/345.4
2008/0290110 A1 11/2008 Gelardi et al.
2011/0204074 A1* 8/2011 Gelardi et al. ..... 221/1
2013/0146610 A1* 6/2013 Gelardi et al. ..... 221/154

* cited by examiner

LOOSE FILL TRAY PACKAGING SYSTEM

This application is a National Phase application of PCT Application PCT/US10/060627 filed 16 Dec. 2010, which claims the benefit of U.S. Provisional Application No. 61/287,968, filed 18 Dec. 2009, each of which is incorporated herein by reference in their entirety.

BACKGROUND

The present invention relates generally to a packaging system that may be a unit dose packaging system for food, medicine, tobacco or other such loose fill products and that may have child-resistant features.

Containers for loose fill products vary from flip-top tins to child resistant prescription medicine bottles. Both of these lack unit dose capabilities. U.S. Pat. No. 7,591,372 discloses a shell and tray (blister) combination that can provide a manner of unit dosage, but looses the benefit or ease of having a loose fill container.

A need exists for a child resistant loose fill package for holding medications or tobacco or other products that may be harmful to young children. A need also exists for a loose fill contained that may provide unit dose capabilities and thus reduce the level of contamination for food products (mints, candy and the like), tobacco products or healthcare products.

SUMMARY OF THE INVENTION

Disclosed is a packaging system for containing and dispensing loose filled product units. An inverted tray is sealed to a backer board with a guide insert disposed there between defining an interior chamber that is also filled with product units. The guide insert includes a base flange, a pair of side flanges that may form a truncated V shape for funneling product units into the truncated area that defines a next dispensing position. A flexible bridge includes at least one high point and a fence portion that can descend into the base flange upon application of sufficient pressure to the at least one high point. This allows a product unit to advance to a dispensing position such that the product units may be dispensed one at a time through user manipulation of the flexible bridge.

An optional access band can be adapted to fit atop the inverted tray and slide along opposing indent portions of the backer board and sealing flange. The access band also includes cut out areas that can be positioned directly above the at least one high point of the flexible bridge when slid into a closed position and can expose the dispensing aperture when slid to an open position.

DETAILED DESCRIPTION OF THE PREFERRED EMBODIMENTS

Figure 1:
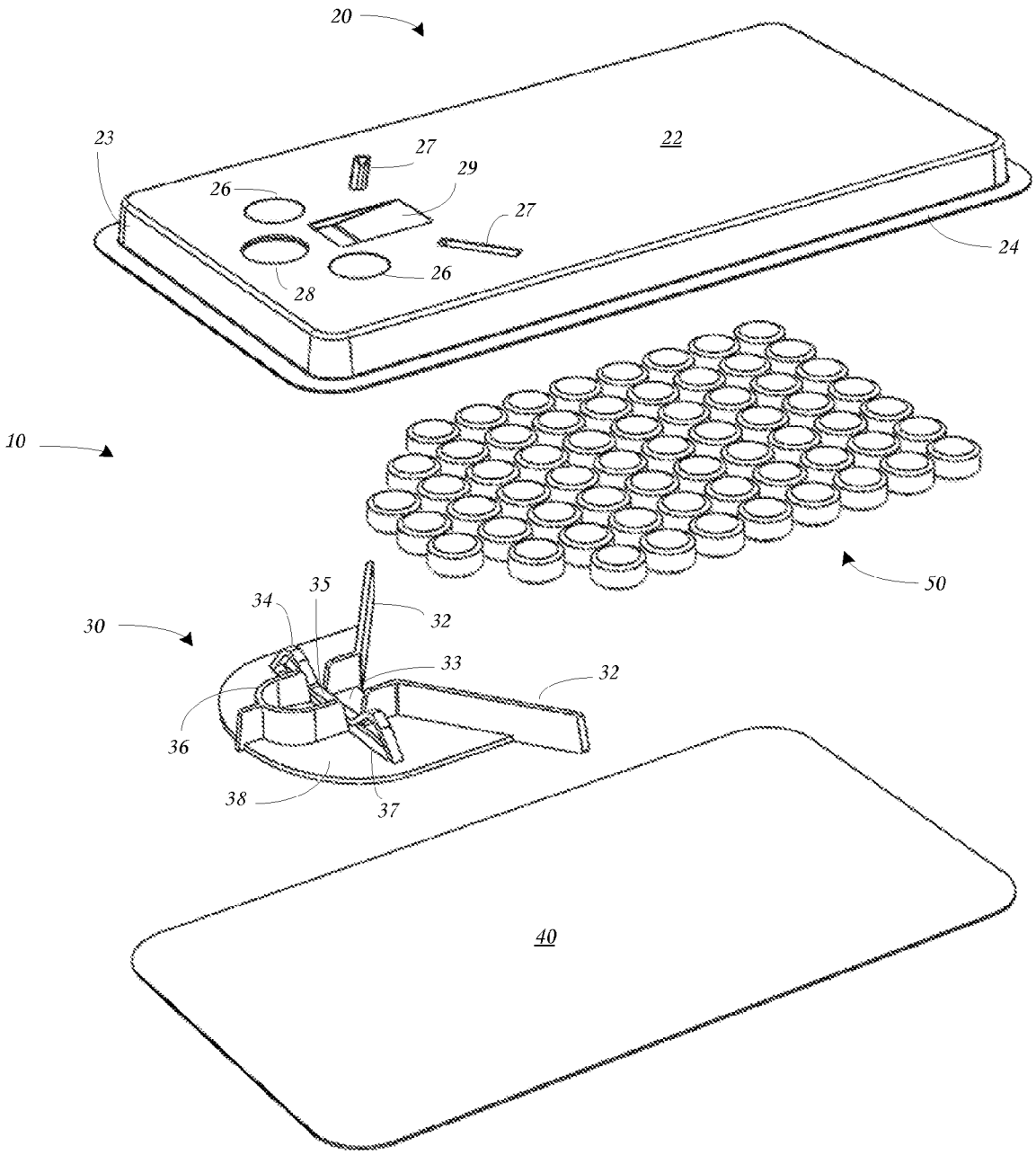
FIG. 1 is an exploded view illustration of a loose fill inverted tray packaging system according to an embodiment of the invention.

FIG. 1 is an exploded view illustration of a loose fill inverted tray packaging system 10 according to an embodiment of the invention. The packaging system 10 is comprised of three main components including a semi-flexible inverted tray 20, a guide insert 30, and a backer board 40. The inverted tray 20 is adhered to the backer board 40 with the guide insert 30 sandwiched in between. A plurality of individual product units 50 are also sandwiched between the inverted tray 20 and the backer board 40.

The inverted tray 20 includes a top surface 22. An overall depth dimension is provided to the packaging system 10 by virtue of a sidewall 23 that surrounds the entire perimeter of the top surface 22. The opposite edge of sidewall 23 flares outward at substantially ninety degrees to form a sealing flange 24. The sealing flange is sized to fit atop the backer board 40 and provide a surface area for adhering the inverted tray 20 to the backer board 40 while defining an interior chamber adapted and sized to receive the guide insert 30 and the product units 50.

The inverted tray 20 further includes a pair of guide insert alignment ribs 27 that indent from the top surface 22 into the interior chamber. The guide insert alignment ribs 27 are oriented to position the guide insert 30 properly between the inverted tray 20 and the backer board 40. Also included is a dispensing aperture 28 sized to allow individual product units 50 to be dispensed from the packaging system 10. There is also at least one push location indicator 26 on the exterior surface of the top surface 22 designed to inform a user where to apply pressure to start the dispensing process. A ramp indent 29 is also shown. The ramp indent 29 is strategically positioned above the funneling point within the chamber that can be termed the next dispensing position. The purpose of ramp indent 29 is to keep the next product unit 50 to be dispensed from hopping over the flexible bridge 34 of the guide insert 30 by reducing the vertical space in that portion of the interior chamber.

The guide insert 30 can be an injection molded plastic apparatus. The guide insert includes a base flange 38 that is adhered to backer board 40 fixing the guide insert 30 in place. Also included is a pair of flared side flanges 32 that generally form a V shape. Each side flange 32 generally extends from a point on the sidewall 23 and extending backward while also extending toward the center of the interior chamber creating the V shape. The height of the side flanges 32 is such that it substantially covers the entire depth of the interior chamber such that none of the product units 50 can accidentally jump over the side flanges 32. In addition, the point of the V shape has been truncated to create a next dispensing position 33 that is directly below ramp indent 29. The V shape is truncated such that only one of the unit products 50 can occupy the next dispensing position 33 at any given time. It is to be understood that the V-shape may be modified based on manufacturing preferences. To conserve space within the package the V shape may be truncated with only one flange forming half a V or the V shape may be eliminated completely. A flexible bridge 34 is comprised of a fence section 35 that serves to block the unit product 50 occupying the next dispensing position 33 from prematurely moving to a dispensing position defined by a ring flange 36. The dispensing position defined by the ring flange 36 is directly below the dispensing aperture 28 of the inverted tray 20 when the packaging system 10 is assembled. The flexible bridge also includes at least one high point that corresponds with the at least one push location indicator 26 on the exterior surface of the top surface 22 of the inverted tray 20. In operation, a user will press on one or more areas of the top surface of the semi-flexible inverted tray 20 corresponding to the high point of the flexible bridge. This action will cause the fence portion 35 of the flexible bridge 34 to deflect downward. The flexible bridge may have one or more pieces that move with respect to one or more points of pressure on the cover or base. The base flange further includes a slit cut out to match the size and shape of the fence portion 35 allowing the fence portion to drop into the surface of the base flange and allow the product unit 50 in the next dispensing position 33 to advance to the dispensing position defined by the ring flange 36.

The backer board 40 is a generally flat yet semi-rigid material that serves as a base for adhering to the inverted tray 20 and the guide insert 30 to complete the interior chamber. The backer board 40 can also be a film, foil, label or any similar material of combination of materials.

Figure 2:
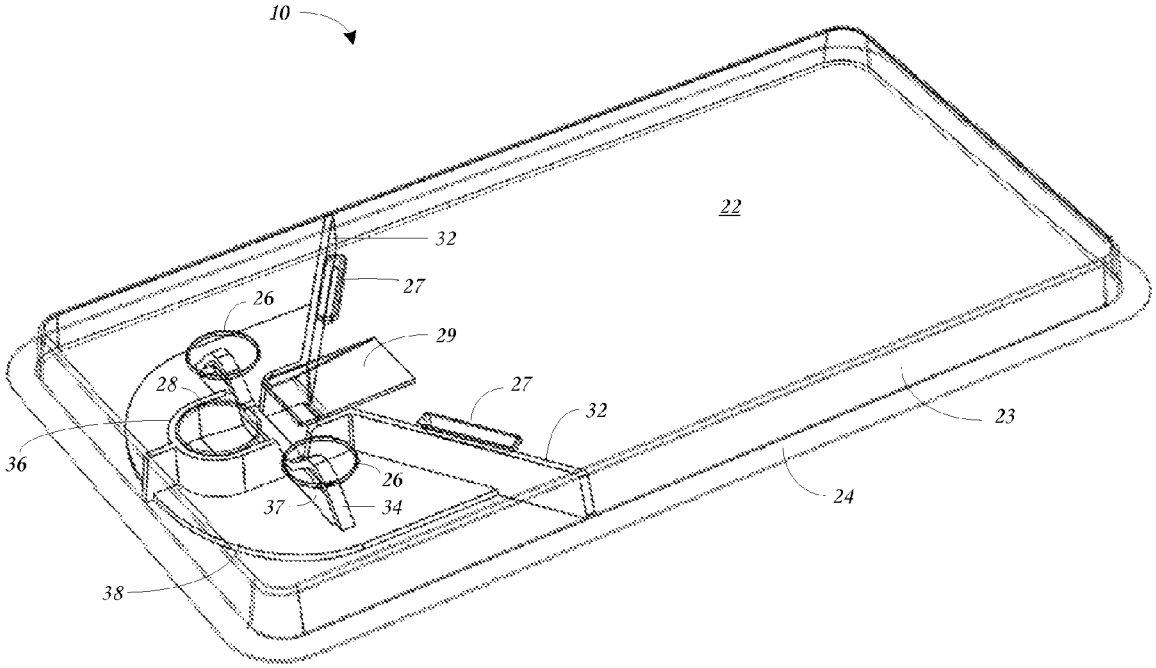
FIG. 2 is an illustration of an assembled loose fill inverted tray packaging system according to an embodiment of the invention.

FIG. 2 is an illustration of an assembled loose fill inverted tray packaging system 10 according to an embodiment of the invention. This view shows how the three main components align with one another when assembled. It can be seen that the alignment ribs 27 that indent from the top surface 22 abut the side flanges 32 of the guide insert 30 to help position the guide insert within the interior chamber. It can also be seen that the push location indicators 26 are directly above the high points of the flexible bridge 34 and the dispensing aperture 28 is substantially above the dispensing position defined by the ring flange 36.

Figure 3:
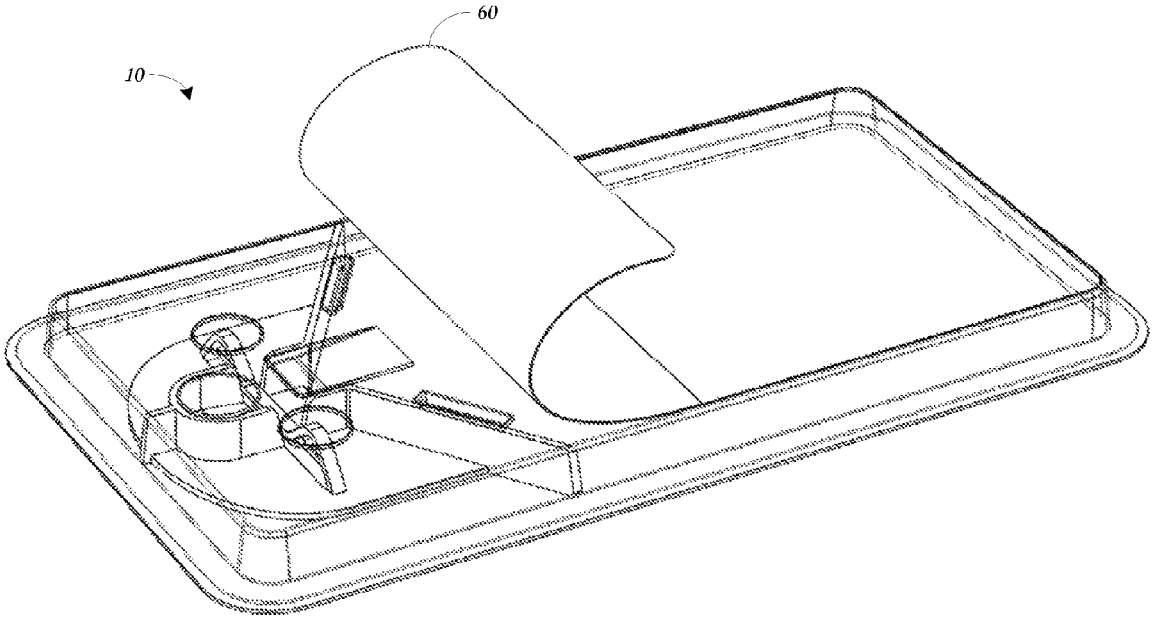
FIG. 3 is an illustration of an assembled loose fill inverted tray packaging system having a re-sealable label affixed thereon according to an embodiment of the invention.

FIG. 3 is an illustration of an assembled loose fill inverted tray packaging system 10 having a re-sealable label 60 affixed thereon according to an embodiment of the invention. The re-sealable label 60 can be peeled back to expose the dispensing mechanism and returned once dispensing is complete. The re-sealable label 60 can include textual and graphical information pertaining to the product units contained therein.

Figure 4:
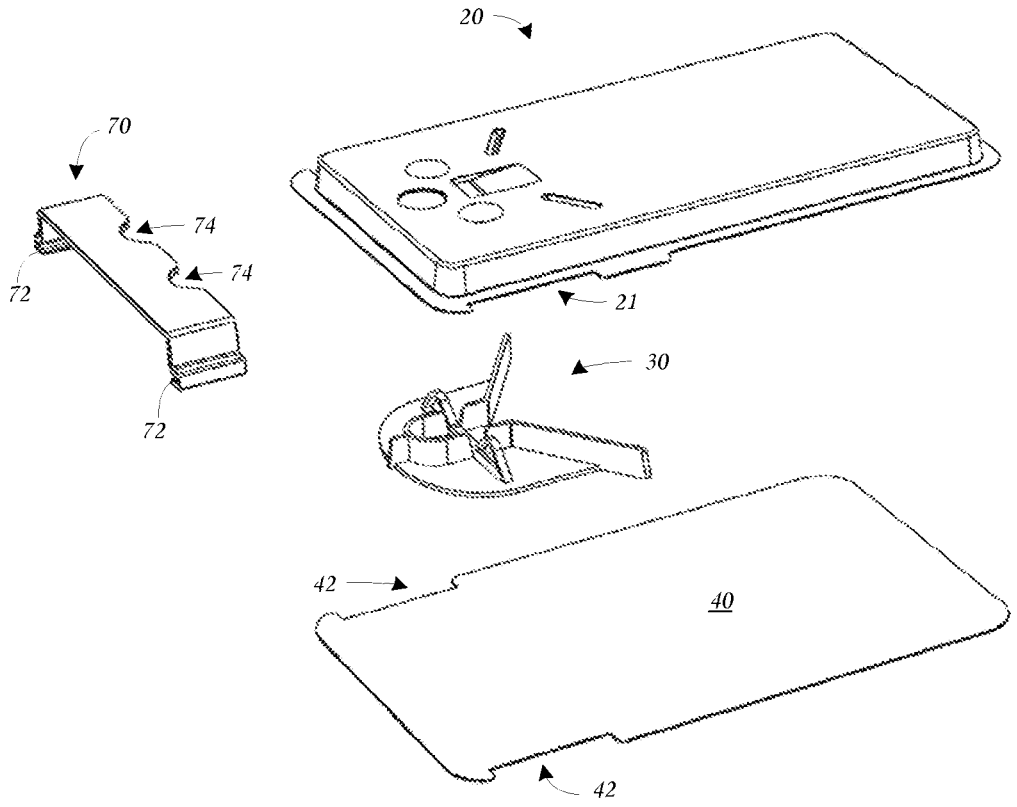
FIG. 4 is an exploded view illustration of a loose fill inverted tray packaging system having an additional external child resistant feature according to an embodiment of the invention.

FIG. 4 is an exploded view illustration of a loose fill inverted tray packaging system having an additional external child resistant feature according to an embodiment of the invention. This embodiment of the invention has added a fourth component to the packaging system 10. The fourth component is an additional child resistant access band 70. The access band 70 is adapted to fit atop the inverted tray and slide along a constrained portion defined by overlapping indented portions 21, 42 of the sealing flange 24 and backer board 40. Sidewalls of the access band 70 terminate in a slotted track 72 adapted to slide within the indented portions 21, 42. The access band 70 further includes cut out areas 74 that provide access to the push location indicators 26 that are directly above the high points of the flexible bridge 34.

Figure 5:
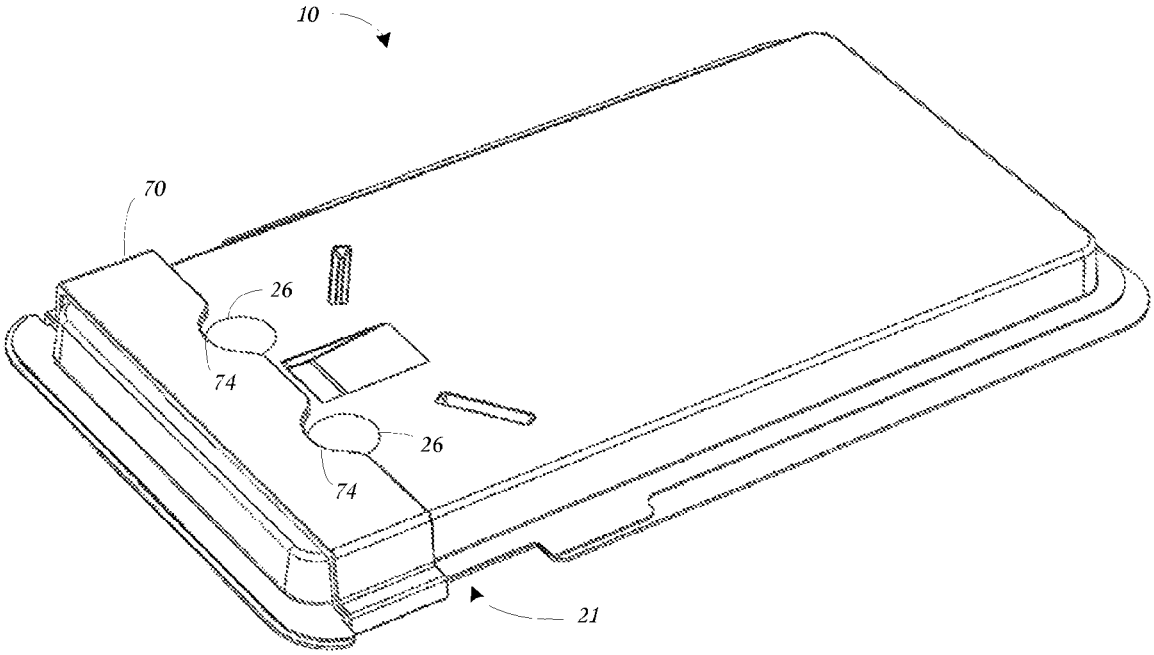
FIG. 5 is an illustration of an assembled loose fill inverted tray packaging system having an additional external child resistant feature in a closed position according to an embodiment of the invention.

FIG. 5 is an illustration of an assembled loose fill inverted tray packaging system 10 having an additional external child resistant feature in a closed position according to an embodiment of the invention. In this position, the cut out areas 74 of access band 70 are directly above the push location indicators 26 that are directly above the high points of the flexible bridge 34. The band further covers the dispensing aperture 28 which prevents contaminants from getting into the interior chamber. This orientation permits a user to press the on the high points of the flexible bridge to commence the dispensing process.

Figure 6:
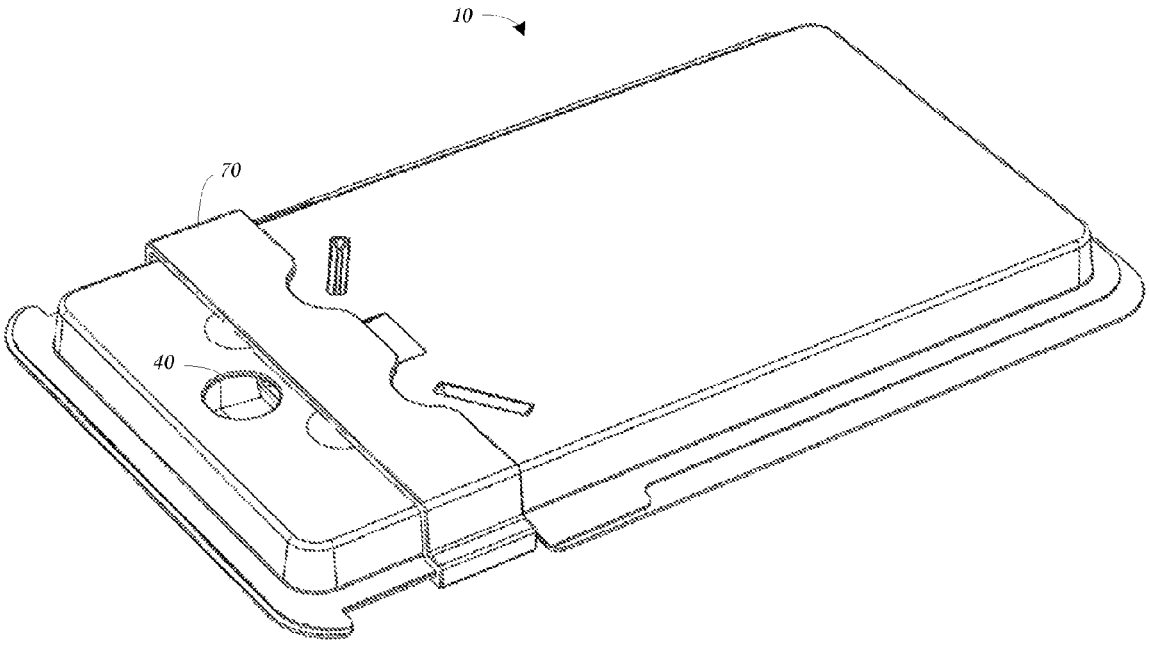
FIG. 6 is an illustration of an assembled loose fill inverted tray packaging system having an additional external child resistant feature in a dispensing position according to an embodiment of the invention.

FIG. 6 is an illustration of an assembled loose fill inverted tray packaging system 10 having an additional external child resistant feature in a dispensing position according to an embodiment of the invention. In this position, the access band 70 has been slid forward to expose the dispensing aperture 28. If the there is a product unit 50 waiting to be dispensed, the user merely tips the entire packaging system 10 until the product unit 50 falls out through the dispensing aperture 28.

To assemble fill the packaging system, the guide insert 30 by way of base flange 38 is adhered to the backer board 40. The product units 50 are placed upon the backer board 40 in a location that is within the open part of the V shape defined by the guide insert side flanges 32. The inverted tray 20 is lowered onto the backer board 40 and the guide insert alignment ribs 27 are positioned adjacent to the side flanges 32. The sealing flange 24 is then adhered to the backer board to close the packaging system 10 thereby creating an interior chamber containing the product units 50.

To dispense a product unit, a user slightly tilts the packaging system 10 forward allowing gravity to funnel the product units 50 along the side flanges or guide portion 32 until one of the product units 50 occupies the next dispensing position 33. It is to be understood that other structures and shape could be used to funnel the product to the opening, including but not limited to blow molded guides in the top or bottom, embossed guides, pegs, or even the container walls themselves. At this point the user can press down on the top surface 22 of the inverted tray 20 corresponding to the high points on the flexible bridge 34 of the guide insert 30. This causes the fence portion 35 of the flexible bridge 34 to descend into the base flange 38 area defined by slit 37. Once there is enough clearance from the descending fence portion 35, the user can again tilt the packaging system 10 slightly forward to allow the product unit to advance past the location where the fence portion 35 was and into a dispensing position defined by ring flange 36. The user then releases pressure on the flexible bridge allowing the fence portion 35 to return to its original location preventing additional product units 50 from prematurely crossing the threshold. The user can then tilt the packaging system 10 until the product unit falls out through the dispensing aperture 28.

The above process includes two additional steps if an access band is present on the outside of the packaging system. The access band must be slid into a closed position to allow the user access to the high points of the flexible bridge. Once the user has moved a product unit 50 from the next dispensing position 33 to the dispensing position defined by ring flange 36, the access band must be slid to its open position exposing the dispensing aperture.

The materials that comprise the main components of the inverted tray 20, guide insert 30, and backer board 40 can vary so long as they maintain sufficient flexibility and rigidity to perform the functions described and attributed to them herein. Furthermore multiple packages could be combined to form a book-style package with one or more inverted trays, guide inserts and backer board(s) as described herein to contain products.

Moreover, the package or packaging system 10 described herein can also become a component to a larger packaging system without departing from the scope of the product dispensing process described above. For example, multiple packages can be combined to form a book style package or be inserted into a paper or plastic outer shell with or without child resistant features.

It is to be understood that the entire package could be a type or plastic material, or paperboard material, or any combination of these. In addition films or foil or other such materials may be added. It could be a single piece of a plastic or paperboard material with the guide portion and bridge portion attached thereto. The guide and bridge portions could be adhered or held in place by portions of the outer walls that form the interior chamber. The also could be held in place by an extra flap of the outer container, such as a paperboard flap with cutouts to fall over the bridge and guide pieces. The entire package could be blow molded such that the guide and bridge portions as well as the dispensing element are all formed in a single piece. The guide and/or bridge elements may be formed in the top portion of the contained and combined with a bottom portion to still allow for easy filing of the product. Or the guide and bridge portion may be formed in the bottom portion still allowing for the easy fill of the interior chamber prior to the top and bottom portions being joined.

This disclosure should not be read as being limited only to the foregoing examples or only to the designated preferred embodiments.

The invention claimed is:

1. A package for containing and dispensing loose filled product units comprising:

an inverted tray comprising a top surface, and a sidewall, and a dispensing aperture;

a guide portion, and a flexible bridge; and a backer board, wherein the inverted, tray and the backer board form an interior chamber, wherein the guide portion comprises a base flange, and wherein the flexible bridge includes at least one high point and a fence portion that can descend into the base flange upon application of sufficient pressure to the at least one high point.

2. The package of claim 1, wherein the sidewall surrounds the perimeter of the top surface, and has a sealing flange at an opposite end of the sidewall and extending outward from the interior chamber.

3. The package of claim 1, wherein the inverted tray and the guide portion are adhered to the backer board having loose filled product units sitting thereon creating a package having an interior chamber in which the product units can be dispensed one at a time through user manipulation of the flexible bridge.

4. The package of claim 1, wherein the guide portion is an insert comprising a pair of side flanges that generally form a truncated V shape for funneling product units into a truncated area that defines a next dispensing position.

5. The package of claim 1 further comprising a re-sealable label affixed to the top surface of the inverted tray wherein the re-sealable label can be peeled backward to expose the dispensing aperture.

6. A package for containing and dispensing loose filled product units comprising:

an inverted tray comprising a top surface, and a sidewall, and a dispensing aperture;

a guide portion, and a flexible bridge; and a backer board, wherein the inverted tray and the backer board form an interior chamber, wherein the guide portion comprises a guide insert, wherein the inverted tray further comprises:

a pair of guide insert alignment ribs that indent from the top surface into the interior chamber for orienting the guide insert between the inverted tray and the backer board;

at least one push location indicator on an exterior of the top surface indicating where to apply pressure to start the dispensing process; and a ramp indent positioned above a next dispensing position within the chamber.

7. The packaging system of claim 6 wherein the guide insert further comprises:

a ring flange defining a dispensing position that corresponds to the dispensing aperture.

8. A package for containing and dispensing loose filled product units comprising:

an inverted tray comprised of a top surface, a sidewall surrounding the entire perimeter of the top surface, a sealing flange at an opposite end of the sidewall and extending substantially outward and having opposing indented portions, and a dispensing aperture;

a guide insert comprising a base flange, a pair of side flanges that generally form a truncated V shape for funneling product units into the truncated area that defines a next dispensing position, and a flexible bridge including at least one high point and a fence portion that can descend into the base flange upon application of sufficient pressure to the at least one high point;

a backer board having opposing indented portions that correspond to the opposing indent portions of the sealing flange; and an access band adapted to fit atop the inverted tray and slide along the opposing indent portions of the backer board and sealing flange, the access band further comprising cut out areas that can be positioned directly above the at least one high point of the flexible bridge when slid into a closed position and can expose the dispensing aperture when slid to an open position;

wherein the inverted tray and the guide insert are adhered to the backer board having loose filled product units sitting thereon creating a package having an interior chamber in which the product units can be dispensed one at a time through user manipulation of the flexible bridge.

9. The package of claim 8 wherein the inverted tray further comprises:

a pair of guide insert alignment ribs that indent from the top surface into the interior chamber for orienting guide insert between the inverted tray and the backer board;

at least one push location indicator on an exterior of the top surface indicating where to apply pressure to start the dispensing process; and a ramp indent positioned above a next dispensing position within the chamber.

10. The package of claim 9 wherein the guide insert further comprises:

a ring flange defining a dispensing position that corresponds to the dispensing aperture.

11. The packaging system of claim 8 further comprising a re-sealable label affixed to the top surface of the inverted tray wherein the re-sealable label can be peeled backward to expose the dispensing aperture.

* * * * *